US007042397B2

(12) United States Patent
Charrier et al.

(10) Patent No.: US 7,042,397 B2
(45) Date of Patent: May 9, 2006

(54) PHASE-SHIFTING CELL FOR AN ANTENNA REFLECTARRAY

(75) Inventors: Michel Charrier, Saclay (FR); Thierry Dean, Gif sur Yvette (FR); Afshin Ziaei, Vanves (FR); Hervé Legay, Plaisance du Touch (FR); Béatrice Pinte, Lanta (FR); Raphaël Gillard, Rennes (FR); Etienne Girard, Octeville (FR); Ronan Moulinet, Plainis (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 10/517,706

(22) PCT Filed: Jun. 13, 2003

(86) PCT No.: PCT/FR03/01803

§ 371 (c)(1),
(2), (4) Date: Dec. 13, 2004

(87) PCT Pub. No.: WO04/001899

PCT Pub. Date: Dec. 31, 2003

(65) Prior Publication Data

US 2005/0219125 A1 Oct. 6, 2005

(30) Foreign Application Priority Data

Jun. 21, 2002 (FR) ..... 02 07743

(51) Int. Cl.
*H01Q 1/38* (2006.01)
*H01Q 13/00* (2006.01)

(52) U.S. Cl. ..... 343/700 MS; 343/778

(58) Field of Classification Search ..... 343/700 MS, 343/876, 755, 776, 778, 779, 781 R, 781 P, 343/781 CA See application file for complete search history.

(56) References Cited

U.S. PATENT DOCUMENTS

| | | | | |
|---|---|---|---|---|
| 3,718,935 | A | 2/1973 | Ranghelli et al. | 343/797 |
| 5,835,062 | A * | 11/1998 | Heckaman et al. | 343/700 MS |
| 6,081,235 | A * | 6/2000 | Romanofsky et al. | 343/700 MS |
| 6,195,047 | B1 * | 2/2001 | Richards | 343/700 MS |
| 6,331,257 | B1 | 12/2001 | Loo et al. | 216/13 |

(Continued)

FOREIGN PATENT DOCUMENTS

DE 299 23 785 5/2001

(Continued)

*Primary Examiner*—Trinh V. Dinh
*Assistant Examiner*—Minh Dieu A
(74) *Attorney, Agent, or Firm*—Lowe Hauptman & Berner, LLP

(57) ABSTRACT

The invention relates to phase-shifting cells constituting the passive reflectarrays of antennas with a reconfigurable transmission direction, transmitting in the microwave range. More particularly, the invention describes, within the context of phase-shifting cells of the type having dipole strands angularly distributed in a star configuration, a novel type of switch consisting of a microelectromechanical device essentially comprising a suspended micromembrane which, under the action of an electrostatic force caused by a control voltage, deforms sufficiently to ensure electrical connection between the strands, making it possible to form a dipole in the desired orientation. In one particular embodiment, the micromembrane can be likened to one of the plates of a capacitor and its deformation corresponds to a substantial increase in the capacitance of this capacitor, thus providing the electrical connection. This switch technology has the advantages of greater fabrication simplicity and of enhanced performance compared with the known technologies. The invention provides the main geometrical and technological characteristics for obtaining optimized performance.

29 Claims, 8 Drawing Sheets

U.S. PATENT DOCUMENTS

| | | | | |
|---|---|---|---|---|
| 6,396,368 | B1 | 5/2002 | Chow et al. | 333/262 |
| 6,404,401 | B1 * | 6/2002 | Gilbert et al. | 343/780 |
| 6,642,889 | B1 * | 11/2003 | McGrath | 343/700 MS |

FOREIGN PATENT DOCUMENTS

| | | |
|---|---|---|
| WO | 02 23672 | 3/2002 |

* cited by examiner

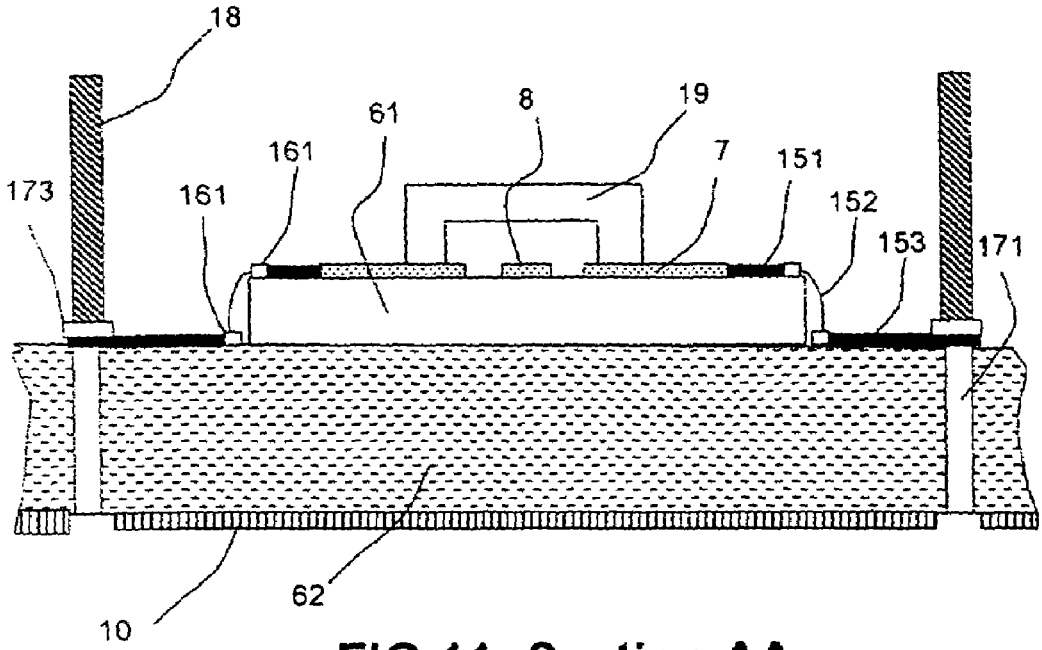
FIG.11- Section AA
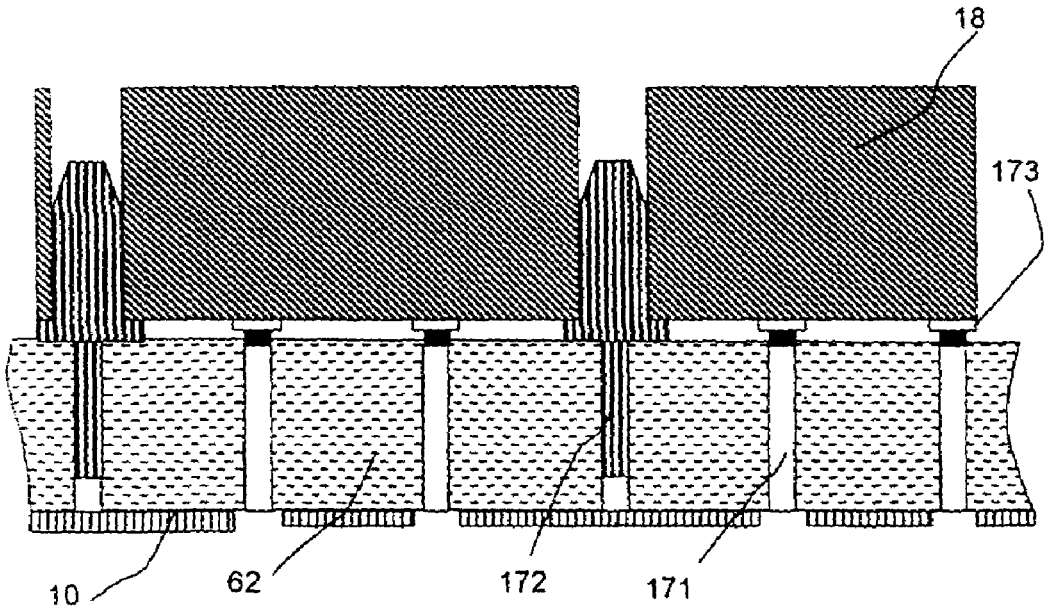
FIG.12- Section BB

PHASE-SHIFTING CELL FOR AN ANTENNA REFLECTARRAY

CROSS-REFERENCE TO RELATED APPLICATIONS

The present Application is based on International Application No. PCT/FR03/01803, filed on Jun. 13, 2003, which in turn corresponds to FR 02/07743 filed on Jun. 21, 2002, and priority is hereby claimed under 35 USC §119 based on these applications. Each of these applications are hereby incorporated by reference in their entirety into the present application.

FIELD OF THE INVENTION

The field of the invention is that of passive reflectarrays composed of a mosaic of elementary phase-shifting cells for an antenna with a reconfigurable transmission direction, operating in the microwave range.

In a large number of applications, it is necessary to be able to point the electromagnetic beam transmitted by an antenna in the desired direction. The possible applications are in particular:

- space telecommunications: tracking of an area on the ground in the case of an orbiting satellite, minimization of the interfering radiation when there is simultaneous use of several signals, reprogramming of the antenna owing to a change in traffic and in-flight redundancy in order to alleviate defective antennas;
- applications on board aircraft: aircraft-satellite communications and radar applications;
- ground applications: millimeter wave communications and meteorological radar applications.

DESCRIPTION OF THE PRIOR ART

To obtain this orientation, there are three possible techniques. Firstly it is possible to mechanically orient the entire antenna in the desired direction. This solution requires mechanical positioning devices that are complex to operate in the case, for example, of space applications. In a second solution, an antenna called an active antenna is produced, this being composed of a plurality of elementary transmitting cells. By controlling the phase of the various signals transmitted by each cell, transmission in the desired direction is obtained. However, this solution, although more flexible than the previous one, has the drawbacks of being expensive and heavy.

The third technical possibility is illustrated in FIGS. 1 and 2 and consists in producing an antenna from a single transmitting source 1 supported by an arm 2, which illuminates a reflectarray 3. The whole assembly is controlled by an electronic signal control module 5. The reflectarray is composed of a mosaic of passive phase-shifting cells 4 generally arranged in a honeycomb, which retransmit a beam in the desired direction. To control the direction of retransmission, it is therefore sufficient to control the phase shift introduced by each cell. This solution has, like the active antenna, the advantage of not requiring moving parts. However, it does not have any of its drawbacks, the operation of a single powerful source being simpler and less expensive to implement than the operation of a multitude of independent sources.

There are several solutions for producing elementary phase-shifting cells. A first solution consists in making the wave of wavelength $\lambda$ propagate along, and causing it to be reflected in, a waveguide of given length L. The phase shift $\Phi$ introduced is then proportional to the ratio $L/\lambda$. The desired phase shift is thus obtained by adapting the length of the waveguide. This phase shift also depends, by the same principle, directly on the wavelength of the transmitted signal and consequently this type of device can only operate over narrow spectral transmission bands.

SUMMARY OF THE INVENTION

To alleviate this drawback, one type of device allows a phase shift whose value is practically wavelength-independent to be obtained (James P. Mongomery: A Microstrip Reflectarray Antenna Element—Antenna Applications Symposium—Sep. 20–22, 1978, pp 1–16, University of Illinois). This device is suitable for waves transmitted in circular polarization.

The basic principle of this type of device is shown schematically in FIGS. 3 and 4. The phase-shifting cell principally comprises a plane dielectric substrate 6 of thickness equal to about one quarter of the central operating wavelength, on which are deposited, on the lower part, a ground plane 10 and, on the upper part an even number of conducting dipole strands 7 arranged in a regular fashion around a central disk 8, which is also conducting. Switching devices 9 are used to connect, on the command, two diametrically opposed strands to the central disk. When two strands are thus connected to the disk, they constitute a radiating dipole having a given geometrical orientation, the other, non-connected, strands not radiating or only very slightly.

The operating principle is the following: let there be a circularly polarized wave incident upon a phase-shifting cell, two of the strands of which are connected to form a dipole. It may be demonstrated that if the electric field vector representing this circular wave makes, at the surface of the dipole, a phase-shift angle $+\theta$ with the direction of said dipole, then the transmitted electric field will make, with the direction of the dipole, a phase-shift angle $-\theta$. Depending on the dipoles created in each phase-shifting cell, it thus becomes possible to control the phase shift introduced and consequently the angle of retransmission of the beam. The major advantage of this arrangement is that the phase shift introduced is thus virtually independent of the wavelength of the signal.

One of the main technological difficulties with this type of phase-shifting cell is the production of the switching devices. Each reflectarray may comprise several tens of phase-shifting cells and consequently several hundred switching devices. They therefore have to be reliable, to be small in size—typically the size of each switch must not exceed a few hundred microns—, to have a low power consumption they must not interfere with the operation of the microwave dipole.

U.S. Pat. No. 5,835,062 (Flat panel-configured electronically steerable phased array antenna having spatially distributed array of fanned dipole sub-array controlled by triode-configured field emission devices) proposes to produce the switches from electronic triodes. This solution requires the production and implantation, for each triode, of a switch consisting of conical microcathodes and annular microanodes. To operate, these devices also require substantial electrical power owing to the large number of switches per reflectarray.

As to the invention, this proposes an alternative solution that makes it possible to simplify the production of the device and to reduce the electrical power consumed. The object of the invention to produce the switches from microelectricalmechanical devices.

The principle of operation of this type of device is illustrated schematically in the FIGS. 5 and 6 in the simplest case of the use as a microswitch. A metal membrane or beam 11 of very small thickness is held suspended by supports 14 above conducting surfaces 12 and 13 that are mutually isolated. The membrane/conducting surfaces assembly may be subjected to an electrical voltage T. In the absence of applied voltage, the membrane is suspended above the conducting surfaces and there is no electrical contact between them. In this case, an electrical current cannot flow between 12 and 13 and the membrane/conducting surfaces assembly is likened to an open switch. When the membrane/conducting surfaces assembly is subjected to an increasing voltage T, the membrane is subjected to an electrostatic force that deforms it until the membrane comes into contact with the conducting surfaces for a voltage $T_C$. The electrical current can then flow from 12 to 13. The membrane/conducting surfaces assembly is then equivalent to a closed switch. Thus, a microswitch is produced. The main advantages of this type of device are essentially:

- the production techniques, which are derived from conventional technologies for the thin-film fabrication of microelectronic circuits, technologies which make it possible to achieve low production costs compared with other technologies, while still guaranteeing high reliability;
- the very low consumed electrical power levels, which are virtually zero;
- the overall size. Thus, a microswitch can be produced in an area of the order of one tenth of a square millimeter; and
- the performance in microwave operation. This type of switch has very low insertion losses, of the order of one tenth of a decibel, much less than those of devices providing the same functions.

More precisely, the subject of the invention is a phase-shifting cell of a reconfigurable reflectarray for an antenna operating in the microwave range, said array comprising a plurality of phase-shifting cells, each of said phase-shifting cells being composed of several electrically conducting strands, characterized in that at least two of said strands may be connected together by means of at least one switching device comprising a microelectromechanical system comprising an electrically controllable flexible membrane, the strands thus connected constituting a radiating dipole.

Within the context of reflectarrays whose geometrical arrangement of the strands is in the form of a star, said phase-shifting cell comprises two plane parallel faces separated by a thickness representing about one quarter of the wavelength of the operating frequency, said first face having a star-configured array consisting of an even number of electrically conducting strands that are all identical and placed uniformly around a central disk, which is also conducting, it being possible for each strand to be electrically connected to the central disk via a switching device dependent on a control voltage, each pair of diametrically opposed strands thus constituting, when the two devices connecting them to the central disk are activated, a resonant dipole in the range of operating frequencies of the antenna, the second face consisting of a ground plane, said cell being characterized in that the switching device consists of a microelectromechanical system comprising a flexible membrane supported by at least two pillars that are placed between said membrane and the first face of the cell, said membrane thus being placed above the end of each strand facing the central disk and that peripheral part of said disk which is placed facing this end, said membrane, when the control voltage is applied, being deformed by the resulting electrostatic force sufficiently to ensure electrical connection between the end of the strand and the corresponding peripheral part of the central disk.

Advantageously, the switching device is of the capacitor type and the electrical connection corresponds to a large increase in its capacitance. Operation of the microswitch as a simple switch with electrical contact between the flexible membrane and the elements of the dipole has the drawback of having a very low reliability. In the operating frequency range considered, the use of a microcapacitor of low capacitance, typically varying from 1 femtofarad in open circuit to 1 picofarad in the closed circuit makes it possible to obtain excellent closed-position coupling and a very good open-position isolation, while considerably increasing the reliability of the device.

Advantageously, the ratio of the value of the capacitance of the capacitor in the absence of a control voltage to the value of the capacitance when the control voltage is applied is of the order of 100. In this case, the plates of the capacitor consist, on the one hand, of the flexible membrane and, on the other hand, of the end of the strand and of the peripheral part of the corresponding disk that are placed beneath this membrane, electrical isolation being provided by a layer of dielectric material covering the strands and the disk. This material is preferably silica nitride. The geometrical and mechanical parameters of the membrane are designed in such a way that the control voltage to be applied, in order to ensure switching, is large compared with the possible parasitic voltages. This control voltage is typically thirty volts. The reliability of the device, the switching time and the control voltage depend partly on the geometrical characteristics of the membrane. The best compromise is obtained when the membrane takes the shape of a rectangular parallelepiped of small thickness, the width of the rectangle typically being one hundred microns, its length three hundred microns and its thickness seven hundred nanometers. The materials used for producing the membrane are advantageously gold, aluminum or tungsten titanium alloys deposited in layers. In the absence of a control voltage, the plates of the capacitor are separated by about three microns.

Advantageously, the end of the strand and the facing part of the central disk that are placed beneath the membrane make up a comb of interdigitated fingers and the total number of fingers is preferably five. The shape, in the form of interdigitated combs, of the two surfaces of the end of the strand and of the facing central disk allow the capacitive effect to be optimized.

The voltages for controlling the switching devices pass via the strands by means of internal resistive lines and the flexible membranes are all connected to the electrical ground, also by means of other internal resistive lines. The material used to produce the various electrical connections is preferably gold. The value of the impedance of the resistive lines at the operating frequency is high enough to isolate all the strands, the central disk and the switching devices from the outside.

Advantageously, the cell is of hexagonal shape and comprises twelve strands, each strand preferably having a flared shape, the flare angle being about 20 degrees. The hexagonal shape of the cell allows complete and uniform paving of the reflectarray space. On principle, the phase shift introduced by each cell is discrete, the minimum phase shift angle being inversely proportional to the number of strands. Of course, it is advantageous to reduce this angle by increasing the number of strands. However, this is limited by the complexity of the interconnection systems when the number of strands to be controlled increases, by the necessary miniaturization limit of the switches, and by the possible inter-strand interference if they are tightly spaced. In practice, having twelve strands per cell is a good compromise between technological complexity and minimum phase shift angle. The dipole wave reflection coefficient depends on the size of the dipole, which is conventionally close to one half-wavelength, but also on its shape, slightly flared shapes being well suited for obtaining good resonance of the dipole.

Advantageously, the electronic system of said cell, formed by the strands, the central disk, the switching devices and the various resistive lines supplying the control voltages and the electrical ground, is implanted on a microwave-transparent substrate; the material used may be silicon or quartz or glass, especially glass with the Pyrex brand name. Said substrate takes the form of a right cylinder with plane parallel faces, of circular or hexagonal base centered on the central disk of the cell.

Advantageously, the upper parts of the substrates, which comprise the central disks and the various switching devices, are protected by one or more protective covers. Each cell may have its own protective cover, or the cover may be a single one, common to the entire reflectarray. The switching devices, which are mechanical parts of very small dimensions of the order of a few microns to a few hundred microns, require a cover for protecting them from external elements such as fluids or dust, which would incur the risk of greatly degrading their performance. In particular, the performance of the metal membranes may be seriously impaired by oxidation.

Advantageously, the substrate common to the reflectarray system has two parallel plane faces, the upper face bearing the various glass substrates corresponding to each cell, and the opposite face having a ground plane, the material of this substrate being a microwave-transparent and electrically insulating material. Preferably, this material is based on PTFE and glass fibers. Neltec sells a material of this type under the brand name METCLAD.

Advantageously, each cell is connected by a honeycomb paving of circular connection holes that are produced in the common substrate and arranged in hexagons, each hexagon being centered on a central disk of the cell, each of the internal resistive lines of a cell that emanate from the strands or from the membranes being connected to these holes via other external resistive connections implanted on the common substrate, the internal resistive lines implanted on the glass substrates of each cell being connected to the external resistive lines implanted on the substrate of the reflectarray by means of wire-bonding connection wires.

Advantageously, the rows of connection holes are common to two adjacent cells and each hexagon of connection studs then has a number of studs equal to at least twice the total number of strands of each cell increased by two, so as to be able to connect two adjacent cells.

It is necessary to ensure isolation of each cell so that a given cell configuration does not interfere with the surrounding cells. This isolation is provided in two ways: firstly, by the connection holes, which act as an electromagnetic barrier if their spacing is small enough compared with the wavelength, and secondly by sets of metal separating walls arranged in a hexagon above the connection holes, said walls being connected together and grounded via metal centering pins located, on one side, in the walls and, on the other side, in certain connection holes reserved for this purpose. The set of walls of the cells then forms a honeycomb grid lying above the reflectarray.

Advantageously, the entire reflectarray is covered with a multilayer dielectric treatment for increasing the effectiveness of the cell when the angle of incidence of the incident or reflected radiation is high.

In general, the process for producing the reflectarray comprises the following steps:

production of the printed circuit substrate, common to the cells by:

deposition of the ground plane and production of the electrical connection studs, plated-through holes and metallized pads;

production of the central microelectronic substrates of the cells;

deposition of the various electronic devices on these substrates by:

production of the strands, the central disk and the resistive lines; and production of the switching devices;

protection of the switching devices by installing covers;

installation of the central substrates on the common substrate;

electrical connection of the resistive lines to the connection studs;

installation of centering pins;

placing of the isolating grids on the centering pins.

Advantageously, the process for producing the switches comprises the following substeps:

deposition of a layer of dielectric material at the location of the interdigitated combs;

deposition of a layer of photoresist covering at least the location of the membrane and of its support pillars;

removal of said resist at the location of each pillar;

creation of the pillars and of the membrane by deposition of one metal layer at the locations of said pillars and of the membrane; and removal of the resist at least beneath the membrane so that the membrane on these pillars is left free.

BRIEF DESCRIPTION OF DRAWINGS

The invention will be more clearly understood and other advantages will become apparent on reading the description that follows, given by way of non-limiting example and with reference to the appended figures in which:

FIG. 11 shows a first sectional view of the cell according to the invention through the center of the cell. For the sake of clarity, the switches have not been shown in this figure;

FIG. 12 shows a second sectional view of the cell according to the invention through the periphery of the cell, illustrating the connection of a metal wall to the common substrate.

DETAILED DESCRIPTION PREFERRED EMBODIMENT

Figure 1:
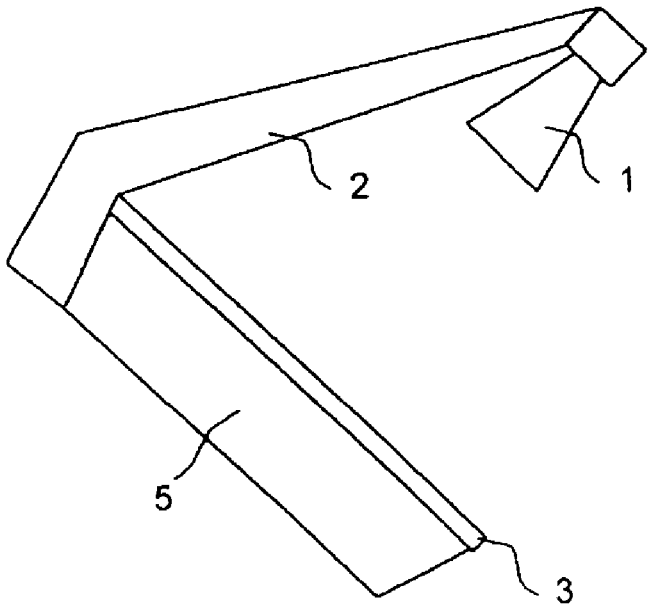
FIG. 1 shows the basic principle of an antenna according to the invention.
Figure 2:
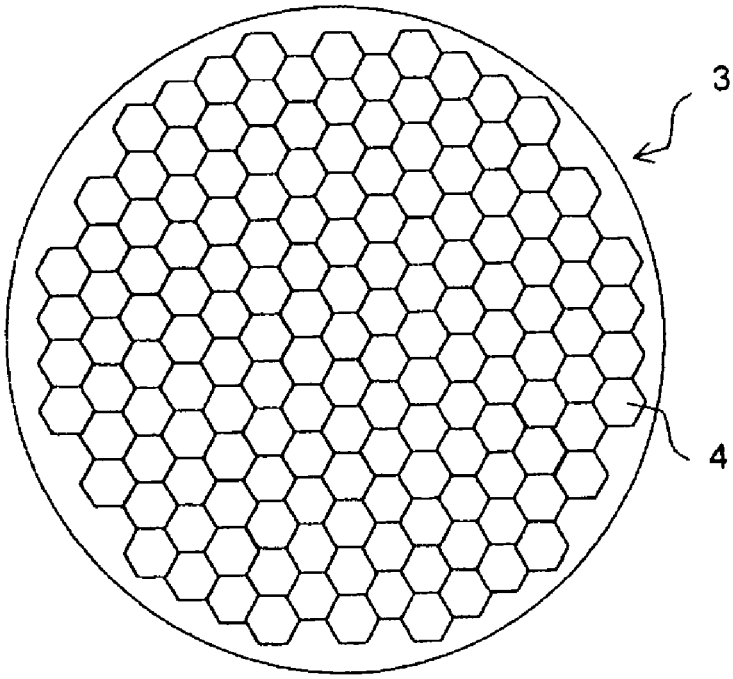
FIG. 2 shows a top view of the reflectarray, illustrating the hexagonal paving of the phase-shifting cells.
Figure 3:
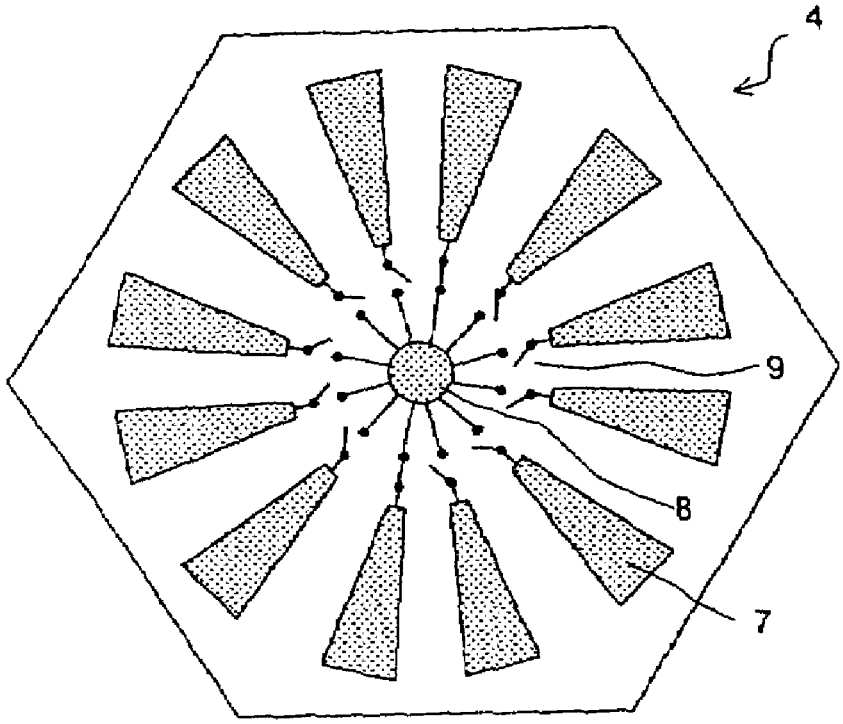
FIG. 3 shows the general principle of each phase-shifting cell with star-configured dipoles seen from above. In this view, the switches are shown by simple switches. In normal operating configuration, only two diametrically opposed switches are closed, the others being left open.
Figure 4:
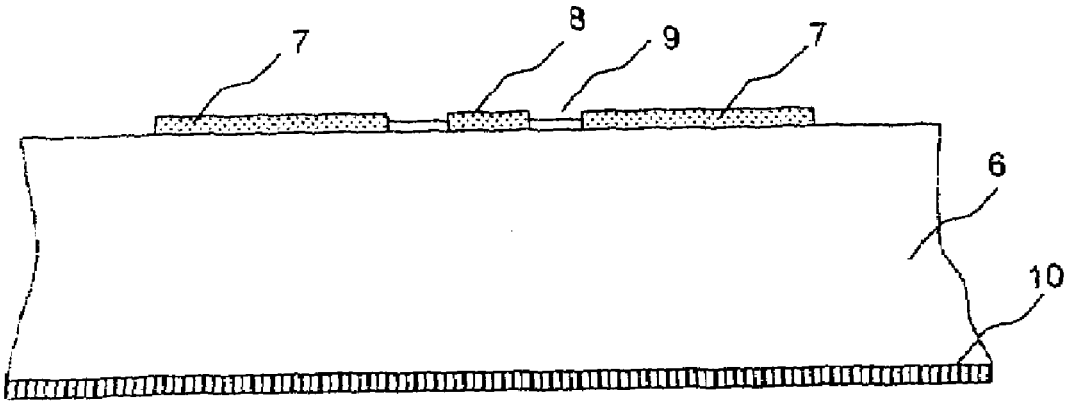
FIG. 4 shows the same diagram as the previous figure, but in cross section.
Figure 5:
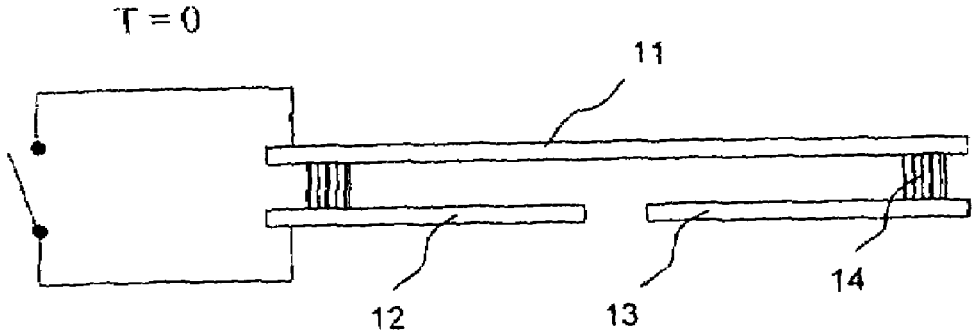
FIG. 5 shows the operating principle of a switch based on an electromechanical device when it is in the OFF position, that is to say when there is no potential difference between the membrane and the conducting surfaces lying beneath it.
Figure 6:
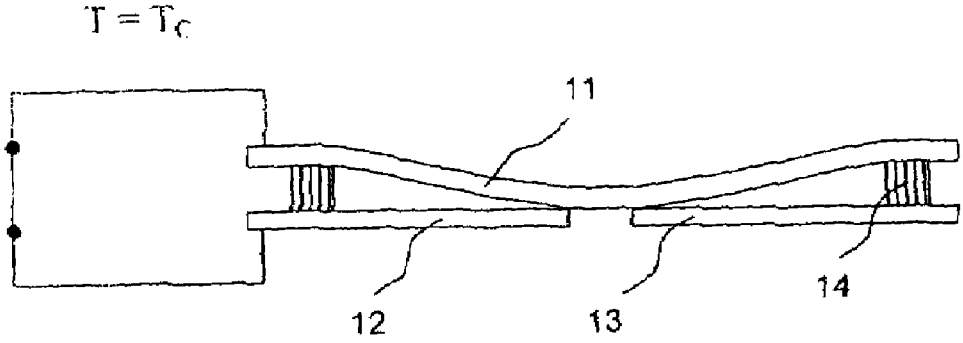
FIG. 6 shows the operating principle of a switch based on an electromechanical device when it is in the ON position, that is to say when a sufficient potential difference exists between the membrane and the conducting surfaces lying beneath it, so that mechanical contact is established.
Figure 7:
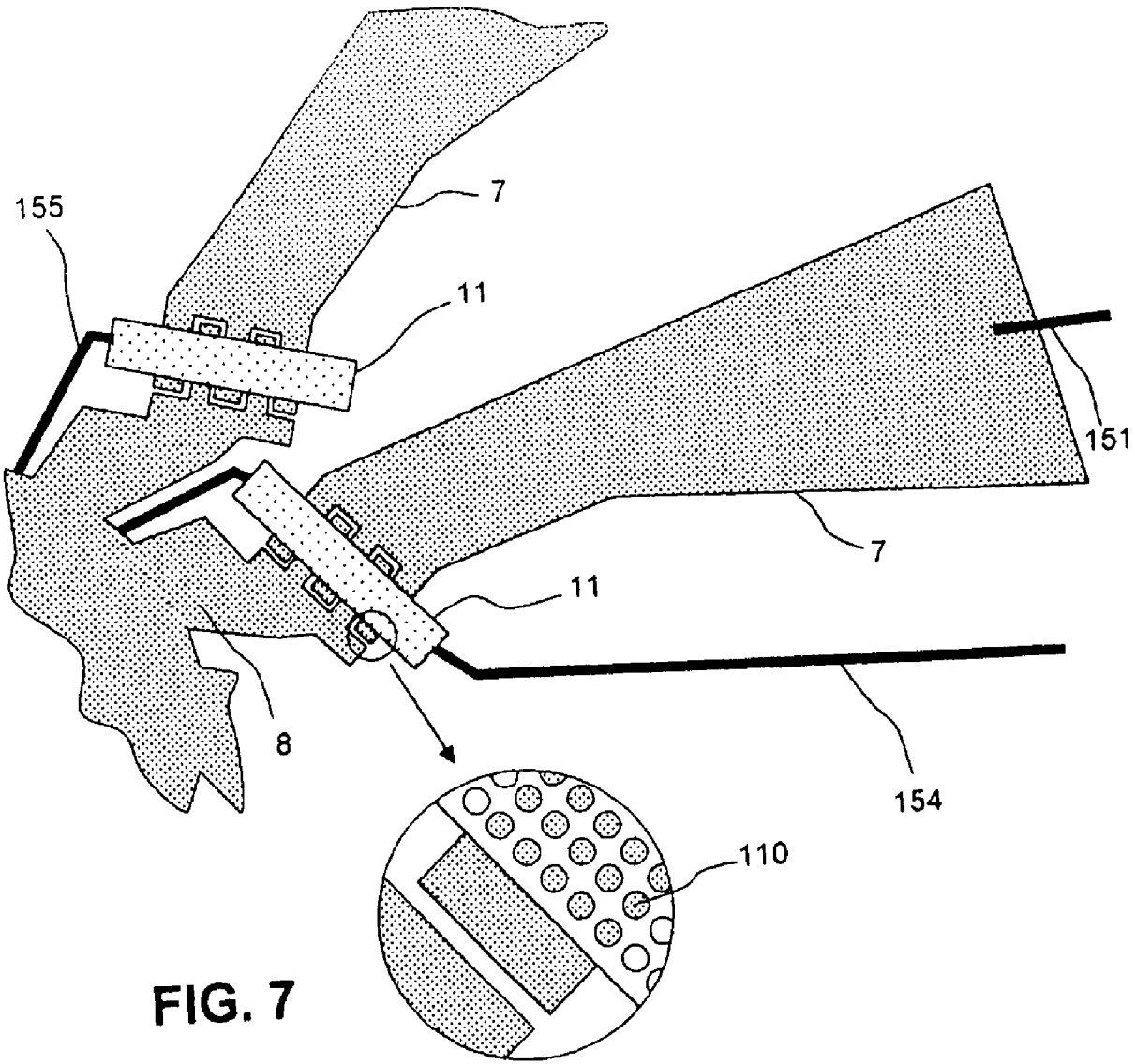
FIG. 7 shows a top view of two switching assemblies according to the invention. Shown in this figure are just the end of two strands facing the central disk, that part of the central disk facing them, the resistive connections and the membrane of each switch.

FIG. 7 shows a top view of the switching devices according to the invention. Two adjacent conducting strands 7 of a phase-shifting cell 4 are shown, together with that part of the central disk 8 facing them. The switching region of each strand is formed by the end of the strand located opposite the central disk. The switching device essentially comprises a membrane 11 placed above the switching region. The control voltages and groundings are applied by means of resistive lines 151, 154 and 155.

Figure 8:
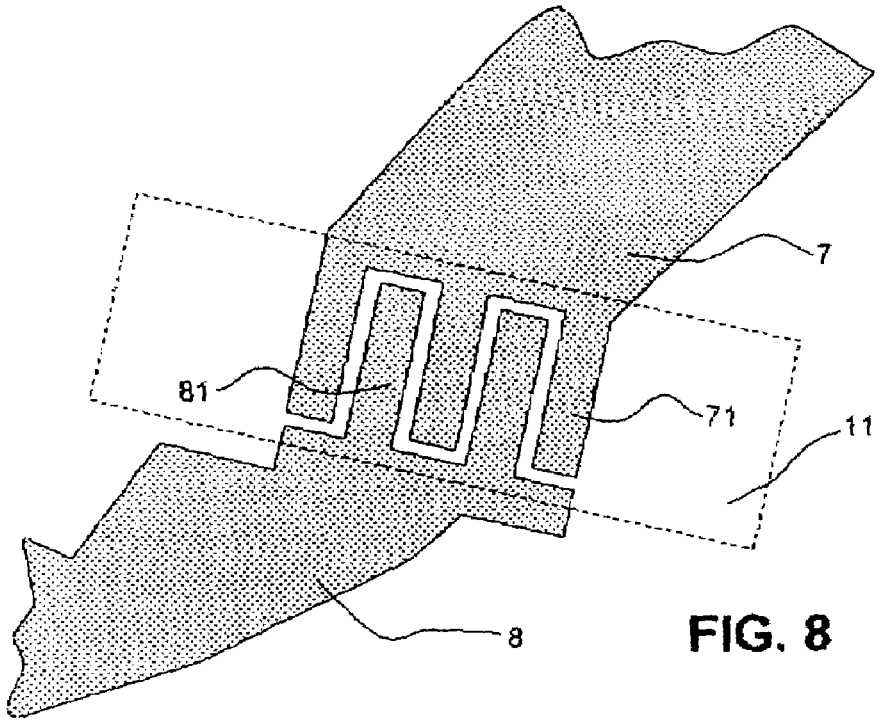
FIG. 8 shows a view of the end of the strand and of the facing part of the central disk, illustrating the interdigitated combs lying beneath the membrane. For the sake of clarity, only the outline of the membrane has been shown by dotted lines.

FIG. 8 shows a detailed view of the switching region. That end 71 of each strand placed on the side facing the central disk and that corresponding part 81 of the disk placed facing this end make up a comb of interdigitated fingers. The region of this comb constitutes the switching region. The advantage of this geometrical arrangement is that it allows the control voltage coming from the strand to be distributed uniformly in the switching region. As an example, FIG. 8 shows five interdigitated fingers, two belonging to the central disk and three belonging to each strand. The entire switching region is covered with a layer of insulating material such as, for example, silica nitride, not shown in the figure.

Figure 9:
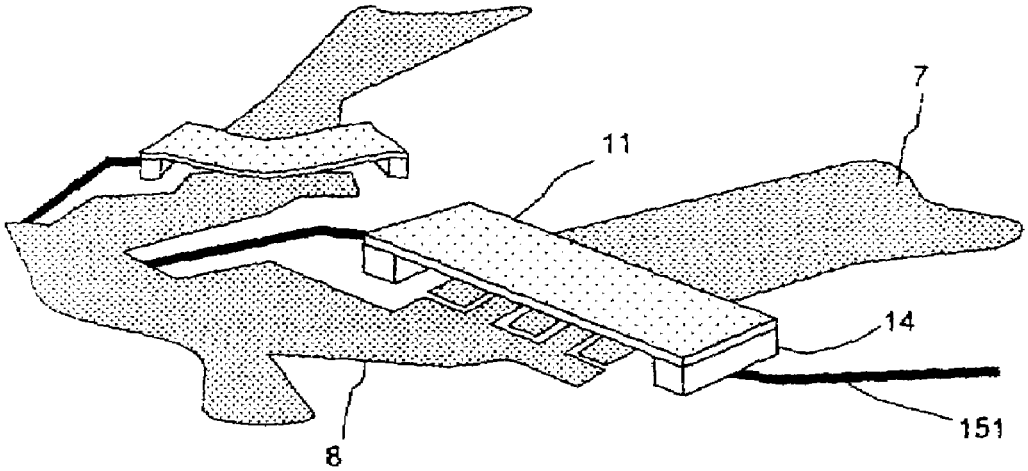
FIG. 9 shows a perspective view of the two switches of FIG. 7, one of the two switches being in the OFF position (straight membrane) and the other being in the ON position (curved membrane)

FIG. 9 shows a perspective view of the two switches shown in FIG. 7. Each membrane is supported by at least two pillars 14 placed on either side of the switching region. The membrane is thus isolated at a certain distance above the switching region. This distance is typically a few microns. Said metal membrane has roughly the shape of a parallelepiped. This shape represents a good compromise between mechanical strength of the membrane, which determines its lifetime and its reliability, and the voltages needed to be applied in order to obtain switching, which voltages must not be too high. Thus, for a membrane having a typical length of three hundred microns, a typical width of one hundred microns and a thickness of seven hundred nanometers, the control voltages are around thirty volts. The membrane is also perforated by a multitude of holes 110 during its production. These holes allow flow of the solvent for freeing the membrane during the production process. For the sake of clarity, these holes are not shown in the various figures illustrating the membrane, except in the detailed view in FIG. 7. The membrane is made of metal. The metals and alloys possible are preferably gold, aluminum, tungsten or titanium.

The assembly consisting of the membrane and the end of the strand and that part of the central disk lying beneath them form the plates of a capacitor, the rest capacitance of which is a few femtofarads. When the membrane is stressed it deforms, approaching the two plates of the capacitor. Its capacitance increases and its value then becomes a few picofarads.

Figure 10:
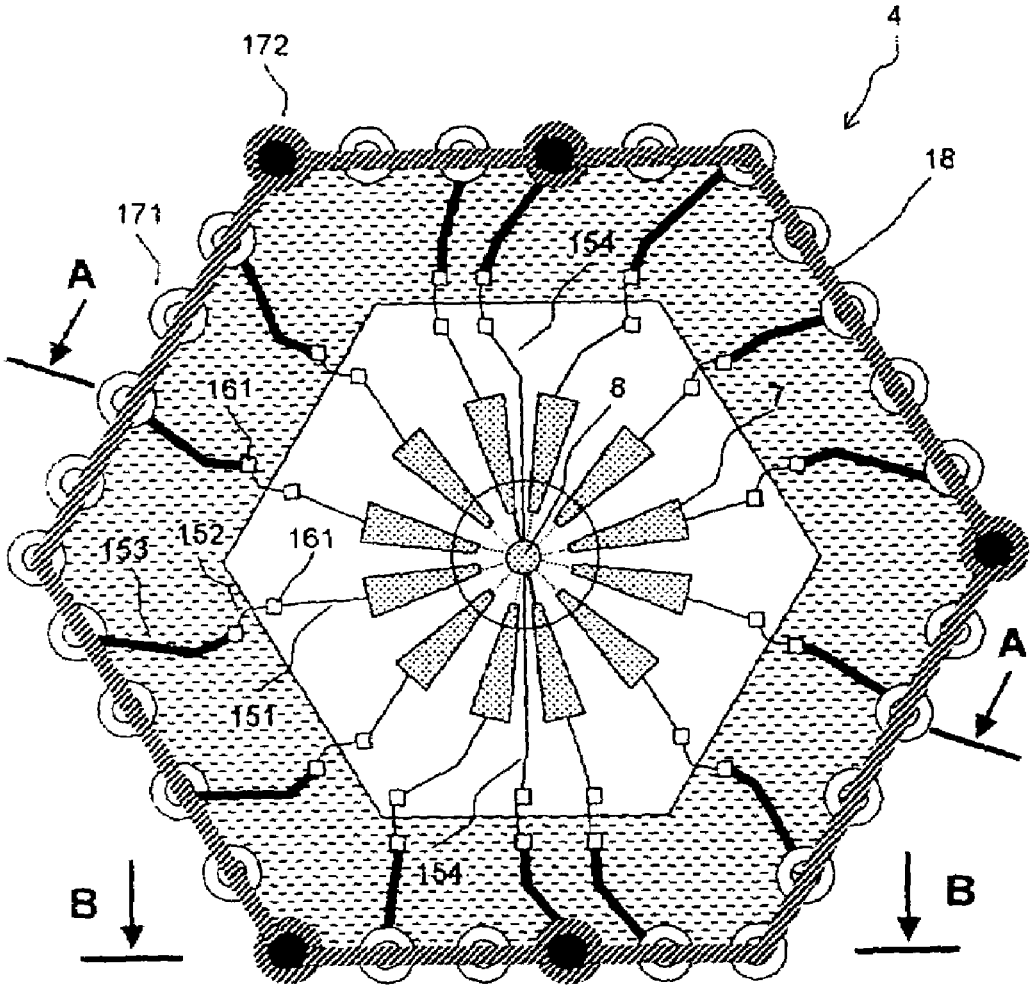
FIG. 10 shows a top view of the cell according to the invention. For the sake of clarity, the switches are shown by dotted lines in the OFF position and by a solid line in the ON position.

FIGS. 10, 11 and 12 show the top view and two sectional views of a cell of the reflectarray according to the invention.

FIG. 10 shows the top view of the cell. The central part of the cell 4 comprises a substrate 61 on which the star-configured array of the electrically conducting strands 7 constituting the various dipoles is implanted, said array being centered on an electrically-conducting central disk 8. The substrate is electrically insulating and transparent to the microwaves. It must be compatible with the technologies for implanting the various electronic components of the cell. For example, this substrate is made of silicon or quartz or glass, especially glass with the Pyrex brand name. There is necessarily an even number of strands, these being arranged symmetrically so that each strand has a diametrically opposed partner. Each pair of diametrically opposed strands thus constitutes a dipole when it is connected to the central disk via the switching devices shown in FIGS. 7, 8 and 9.

The control voltages and groundings are applied by means of resistive lines 151, 154 and 155 connected, on one side, to the various strands and to the switching membranes and, on the other side, to connection pads 161 placed around the perimeter of the central substrate. A first series of control lines 151 is connected to the end of each strand, as shown in FIG. 10. Two diametrically opposed grounding lines 154 connect two membranes to ground, the other membranes and the central disk are connected to these two membranes via other resistive lines 155, as shown in FIG. 10. The resistive lines 151, 154 and 155 have a high enough resistance for all of the strands and the switching devices to be fully electrically isolated from the microwaves. Typically, the resistive lines deposited have an ohmic resistance of a few hundred ohms/square.

The strands preferably have a flared shape so as to increase the efficiency of the dipole. The flare angle is about twenty degrees. The length of each strand is about one quarter of the operating microwave wavelength. The central substrates corresponding to a given cell are implanted in a regular manner on a substrate 62 common to all the cells 4 of the reflectarray. This substrate is also electrically insulating and microwave-transparent. It must be compatible with the technologies for implanting the various electronic components of the cell. This substrate is produced especially from a composite based on PTFE and glass fibers. This type of material is sold by Neltec under the brand name MET-CLAD. The total thickness of the common substrate and of each central substrate is about one quarter of the operating microwave wavelength, i.e. around one to two millimeters given the operating frequencies. This substrate has, on the opposite side from that of the central substrates, a ground plane 10.

Figure 13:
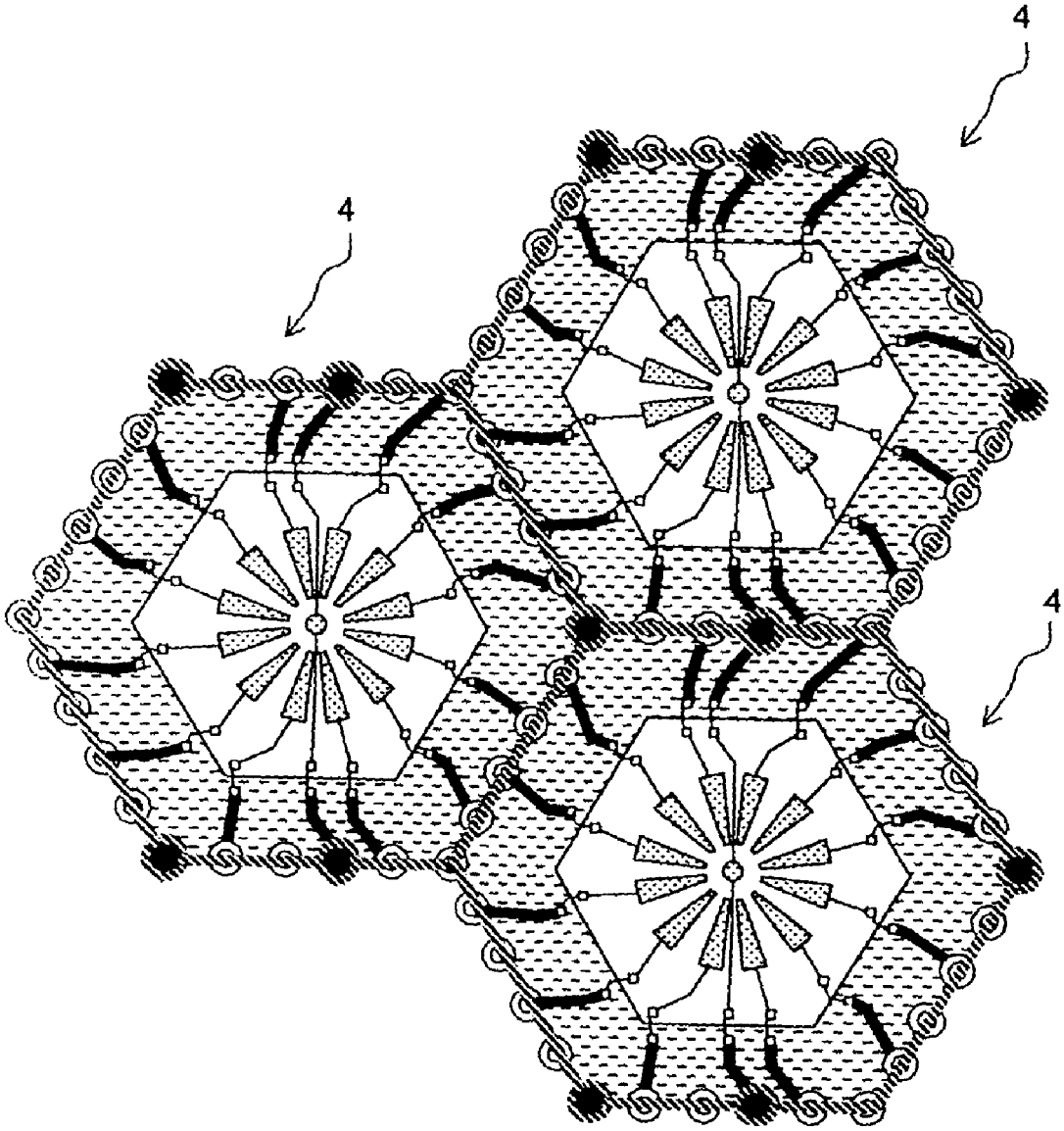
FIG. 13 shows the general arrangement of the three adjacent cells in plan view.

The common substrate includes a paving of electrical connection studs 171 and 172 arranged in a regular fashion in a hexagonal pattern. Each hexagon is centered on a central cell substrate, as indicated in FIGS. 7 and 13, and is composed of six rows of at least six connection studs. The studs of each row are uniformly spaced apart. They pass right through the common substrate (see FIG. 12).

Each cell is surmounted by a set of six metal walls 18 (see FIG. 12) which are also arranged in a hexagon and placed above the rows of connection studs, the whole assembly forming a honeycomb grid (see FIGS. 10 and 13).

There are two types of stud. The first type is used to connect the resistive control lines to the outside of the reflectarray, toward the electronic control module, and are isolated from the ground plane. The second type is used, on the one hand, to mechanically fasten the metal walls to the common substrate, by means of the fastening pins 172, and, on the other hand, to connect these walls to the ground plane, as indicated in FIG. 12.

The studs of the first type are connected to the resistive lines 151 and 154 of the common substrates via other resistive lines 153 interconnected by means of wire-bonding connection wires 152, as indicated in FIG. 10. Said resistive lines 153 have a high enough resistance for all of the strands and the switching devices to be fully electrically isolated from the microwaves. Typically, the resistive lines deposited have an ohmic resistance of about 1 kilohms/square. The studs are isolated from the metal walls by insulating pads 173. The arrangement of the resistive lines connected to the interconnection studs is indicated in FIGS. 10 and 13. This arrangement makes it possible not only to have the same geometrical arrangement for all the cells of the reflectarray but also to minimize the lengths of the resistive lines.

The switching devices have to be protected as they are mechanically fragile. This protection is provided, i.e. at each cell, by a protective cover 19 as indicated in FIG. 11, which shows a sectional view of the cell. This cover 19 must also be microwave-transparent. It may also be common to the entire reflectarray.

The central substrates may also be covered with a multilayer dielectric treatment so as to increase the efficiency of the cells at a high angle of incidence.

The principle of operation of the reflectarray is the following:

- to obtain reflection of the microwaves delivered by the transmitter in a specified direction, the electronic module calculates, for each cell, the geometrical arrangement of the dipoles to be activated;
- for each cell, the electronic module generates the control voltages that are sent to the two diametrically opposed strands to be activated; and
- under the effect of the voltage, the two membranes placed above the activated strands deform (see FIG. 9). The capacitance existing between the plates greatly increases. The order of magnitude of the ratios of the capacitances in the two states of the switch is about one hundred. The impedance of the switching device becomes negligible and the two pressed strands are connected to the central disk, thus forming a dipole.

The switching devices are operated simultaneously for two opposed strands by two separate voltage control signals, the geometry of the device not allowing the two strands to be connected to the central disk simultaneously by a common control signal.

In general, the process for producing the reflectarray comprises the following steps:

- production of the printed circuit substrate, common to the cells by:
  - deposition of the ground plane and
  - production of the electrical connection studs, plated-through holes and metallized pads;
- production of the central microelectronic substrates of the cells;
- deposition of the various electronic devices on these substrates by:
  - production of the strands, the central disk and the resistive lines; and
  - production of the switching devices;
- protection of the switching devices by installing covers;
- installation of the central substrates on the common substrate;
- electrical connection of the resistive lines to the connection studs;
- installation of centering pins;
- placing of the isolating grids on the centering pins.

The process for producing the switches comprises the following substeps:

- deposition of a layer of dielectric material at the location of the interdigitated combs;
- deposition of a layer of photoresist covering at least the location of the membrane and of its support pillars;
- removal of said resist at the location of each pillar;
- creation of the pillars and of the membrane by deposition of one metal layer at the locations of said pillars and of the membrane; and
- removal of the resist at least beneath the membrane so that the membrane on these pillars is left free.

The invention claimed is:

1. A phase-shifting cell of a reconfigurable reflectarray for an antenna operating in the microwave range, said reflectarray comprising:

- a plurality of identical elementary phase-shifting cells, each of said cells having two plane parallel faces separated by a thickness representing about one quarter of the wavelength of the operating frequency; said first face having a star-configured array including an even number of electrically conducting strands that are all identical and placed uniformly around a central disk, which is also conducting;
- it being possible for each strand to be electrically connected to the central disk via a switching device dependent on a control voltage;
- each pair of diametrically opposed strands thus constituting, when the two switching devices connecting them to the central disk are activated, a resonant dipole in the range of operating frequencies of the antenna, the second face including a ground plane, said cell each switching device including a micro-electromechanical system comprising a flexible membrane supported by at least two pillars that are placed between said membrane and the first face of the cell, said membrane thus being placed above the end of each strand facing the central disk and that peripheral part of said disk which is placed facing this end, said membrane, when the control voltage is applied, being deformed by the resulting electrostatic force sufficiently to ensure electrical connection between the end of the strand and the corresponding peripheral part of the central disk, said switching device being of the capacitor type and the electrical connection corresponds to a large increase in its capacitance.

2. The phase-shifting cell as claimed in claim 1, wherein the ratio of the value of the capacitance of the capacitor in the absence of a control voltage to the value of the capacitance when the control voltage is applied is of the order of 100.

3. The phase-shifting cell as claimed in claim 2, wherein, in the absence of a control voltage, the space between the membrane and those parts of the central disk and of the strand that are placed beneath it is about three microns.

4. The phase-shifting cell as claimed in claim 1, wherein the plates of the capacitor include one of the flexible membrane and, on the other hand, of the end of the strand and of the peripheral part of the corresponding disk that are placed beneath this membrane, electrical isolation being provided by a layer of dielectric material covering the strands and the disk.

5. The phase-shifting cell as claimed in claim 4, wherein the dielectric material used is preferably silica nitride ($Si_3N_4$).

6. The phase-shifting cell as claimed in claim 1, wherein the geometrical and mechanical parameters of the membrane are designed in such a way that the control voltage to be applied, in order to ensure switching, is large compared with the possible parasitic voltages.

7. The phase-shifting cell as claimed in claim 6, wherein this control voltage is typically thirty volts.

8. The phase-shifting cell as claimed in claim 6, wherein the membrane has roughly the shape of a rectangular parallelepiped of small thickness, the width of the rectangle typically being one hundred microns, its length three hundred microns and its thickness seven hundred nanometers.

9. The phase-shifting cell as claimed in claim 6, wherein the membrane and the pillars that support it consist mainly of gold or aluminum layers or layers of tungsten titanium alloys.

10. The phase-shifting cell as claimed in claim 1, wherein the end of the strand and the facing part of the central disk that are placed beneath the membrane make up a comb of interdigitated fingers.

11. The phase-shifting cell as claimed in claim 10, wherein the total number of fingers is five.

12. The phase-shifting cell as claimed in claim 1, wherein the voltages for controlling the switching devices pass via the strands by means of internal resistive lines and in that the flexible membranes are all connected to the electrical ground, also by means of other internal resistive lines.

13. The phase-shifting cell as claimed in claim 12, wherein the material used to produce the various electrical connections is preferably gold.

14. The phase-shifting cell as claimed in claim 12, wherein the value of the impedance of the resistive lines at the operating frequency is high enough to isolate all the strands, the central disk and the switching devices from the outside.

15. The phase-shifter device as claimed in claim 1, wherein the cell is of hexagonal shape and comprises twelve strands.

16. The phase-shifting cell as claimed in claim 1, wherein each strand has a flared shape, the flare angle being about 20 degrees.

17. The cell as claimed in claim 1, wherein the electronic system of said cell, formed by the strands, the central disk, the switching devices and the various resistive lines supplying the control voltages and the electrical ground, is implanted on a central microwave-transparent substrate, this substrate being especially made of silicon or quartz or glass, especially glass with the Pyrex brand name.

18. The process for producing the cell as claimed in claim 17 wherein it comprising the following steps:

production of the printed circuit substrate, common to the cells by:

deposition of the ground plane and production of the electrical connection studs, plated-through holes and metallized pads;

production of the central microelectronic substrates of the cells;

deposition of the various electronic devices on these substrates by:

production of the strands, the central disk and the resistive lines and production of the switching devices;

protection of the switching devices by installing covers;

installation of the central substrates on the common substrate;

production of the resistive lines and their electrical connection to the connection studs; and placing of the isolating grids on the rows of connection studs and installation of the mechanical supports.

19. The cell as claimed in claim 1, wherein said substrate takes the form of a right cylinder with plane parallel faces, of circular or hexagonal base centered on the central disk of the cell.

20. The cell as claimed in claim 1, wherein the upper part of the substrate, which comprises the central disk and the various switching devices, is protected by a protective cover transparent to the operating microwave electromagnetic waves.

21. The cell as claimed in claim 1, wherein the substrate common to the reflectarray system has two plane parallel faces, the upper face bearing the various central substrates corresponding to each cell, and the opposite face having a ground plane.

22. The cell as claimed in claim 21, wherein the substrate is based in particular on PTFE and glass fibers, this substrate possibly being the material having the brand name MET-CLAD, sold by Neltec.

23. The cell as claimed in claim 1, wherein each cell is connected by a paving of circular connection studs that are produced in the common substrate and arranged in rows forming a hexagon, each hexagon being centered on the central disk of each cell, each of the internal resistive lines of a cell that emanate from the strands or from the membranes being connected to these studs via other external resistive connections implanted on the common substrate, the internal resistive lines implanted on the central substrates of each cell being connected to the external resistive lines implanted on the substrate of the reflectarray by means of wire-bonding connection wires.

24. The cell as claimed in claim 23, wherein each hexagon of connection studs has a number of studs equal to at least twice the total number of strands of each cell, increased by two.

25. The cell as claimed in claim 23 wherein the rows of connection holes are common to two adjacent cells.

26. The cell as claimed in claim 1 wherein each cell is surmounted by a set of six metal separating walls arranged in a hexagon above the connection holes, said walls being connected together and grounded via metal pins located, on one side, in the walls and, on the other side, in certain connection holes reserved for this purpose such that the set of walls of the cells forms a honeycomb grid lying above the reflectarray.

27. The cell as claimed in claim 1 wherein the electrical isolation of each cell with respect to the adjacent cells is achieved, on the one hand, by the paving with connection holes and, on the other hand, by the metal walls placed above each cell.

28. The cell as claimed in one of claim 1, wherein the entire reflectarray is covered with a multilayer dielectric treatment.

29. A process for producing the cell as claimed in claim 1, wherein the step for producing the switches comprises the following substeps:

deposition of a layer of dielectric material at the location of the switching region;

deposition of a layer of photoresist covering at least the location of the membrane and of its support pillars;

removal of said resist at the location of each pillar;

creation of the pillars and of the membrane by deposition of at least one metal layer at the locations of said pillars and of the membrane; and removal of the resist at least beneath the membrane so that the membrane on these pillars is left free.

* * * * *